United States Patent [19]

Asakura et al.

[11] 4,336,752

[45] Jun. 29, 1982

[54] PRINTING APPARATUS OF CHARACTER WHEEL SELECTION, STOP AND SIMULTANEOUSLY PRINTING TYPE

[75] Inventors: Osamu Asakura, Tokyo; Mineo Nozaki, Kawasaki, both of Japan

[73] Assignee: Canon Kabushiki Kaisha, Tokyo, Japan

[21] Appl. No.: 94,789

[22] Filed: Nov. 16, 1979

[30] Foreign Application Priority Data

| | | | |
|---|---|---|---|
| Nov. 28, 1978 | [JP] | Japan | 53/146786 |
| Nov. 28, 1978 | [JP] | Japan | 53/146787 |
| Nov. 28, 1978 | [JP] | Japan | 53/146788 |
| Nov. 28, 1978 | [JP] | Japan | 53/146789 |
| Nov. 28, 1978 | [JP] | Japan | 53/146790 |
| Nov. 28, 1978 | [JP] | Japan | 53/146791 |
| Mar. 23, 1979 | [JP] | Japan | 54/34509 |

[51] Int. Cl.[3] ..... B41J 1/44

[52] U.S. Cl. ..... 101/99; 101/382 MV; 101/95

[58] Field of Search ..... 101/95, 96, 99, 93.22, 101/110, 382 MV, 328, 35

[56] References Cited

U.S. PATENT DOCUMENTS

| | | | |
|---|---|---|---|
| 1,890,371 | 12/1932 | Dennis | 101/328 |
| 3,884,144 | 5/1975 | Shimodaira | 101/99 |
| 3,946,666 | 3/1976 | Yokoyama | 101/99 |
| 3,967,550 | 7/1976 | Busch | 101/110 X |
| 3,977,317 | 8/1976 | Delligatti | 101/35 |
| 4,033,256 | 7/1977 | Hanaoka | 101/99 |
| 4,104,967 | 8/1978 | Okabe | 101/99 |
| 4,111,117 | 9/1978 | Fezuka et al. | 101/99 X |
| 4,142,463 | 3/1979 | Mitsui et al. | 101/99 |
| 4,182,240 | 1/1980 | Mitsui et al. | 101/99 |

*Primary Examiner*—Edward M. Coven

*Attorney, Agent, or Firm*—Fitzpatrick, Cella, Harper & Scinto

[57] ABSTRACT

A printing apparatus of the type in which character wheels of respective columns are independently rotatably juxtaposed and the character wheel of each column is individually rotation-controlled to select a desired one of characters on the outer periphery of the character wheel at a print position, characterized in that the apparatus is compact and light in weight.

5 Claims, 37 Drawing Figures

C
C1
2
52
5(53)
61
63
22
G1
G2
G3
G4
G5
G6
G7
G8
G9
M
4
41
42
43
44
71
72
31
32
3
7
73
1

PRINTING APPARATUS OF CHARACTER WHEEL SELECTION, STOP AND SIMULTANEOUSLY PRINTING TYPE

BACKGROUND OF THE INVENTION

1. Field of the Invention

This invention relates to a character wheel selection type printing apparatus (printer) utilized as the apparatus for recording the operation results of a recording type small electronic calculator, namely, a printing apparatus of the type in which character wheels of respective columns are independently rotatably juxtaposed and the character wheel of each column is individually rotation-controlled to select a desired one of characters on the outer periphery of the character wheel at a print position to thereby effect printing.

SUMMARY OF THE INVENTION

It is the object of the present invention to provide a printing apparatus of the described type which is compact and light in weight.

The invention will become fully apparent from the following detailed description thereof taken in conjunction with the accompanying drawings.

DESCRIPTION OF THE PREFERRED EMBODIMENTS

Figure 1:
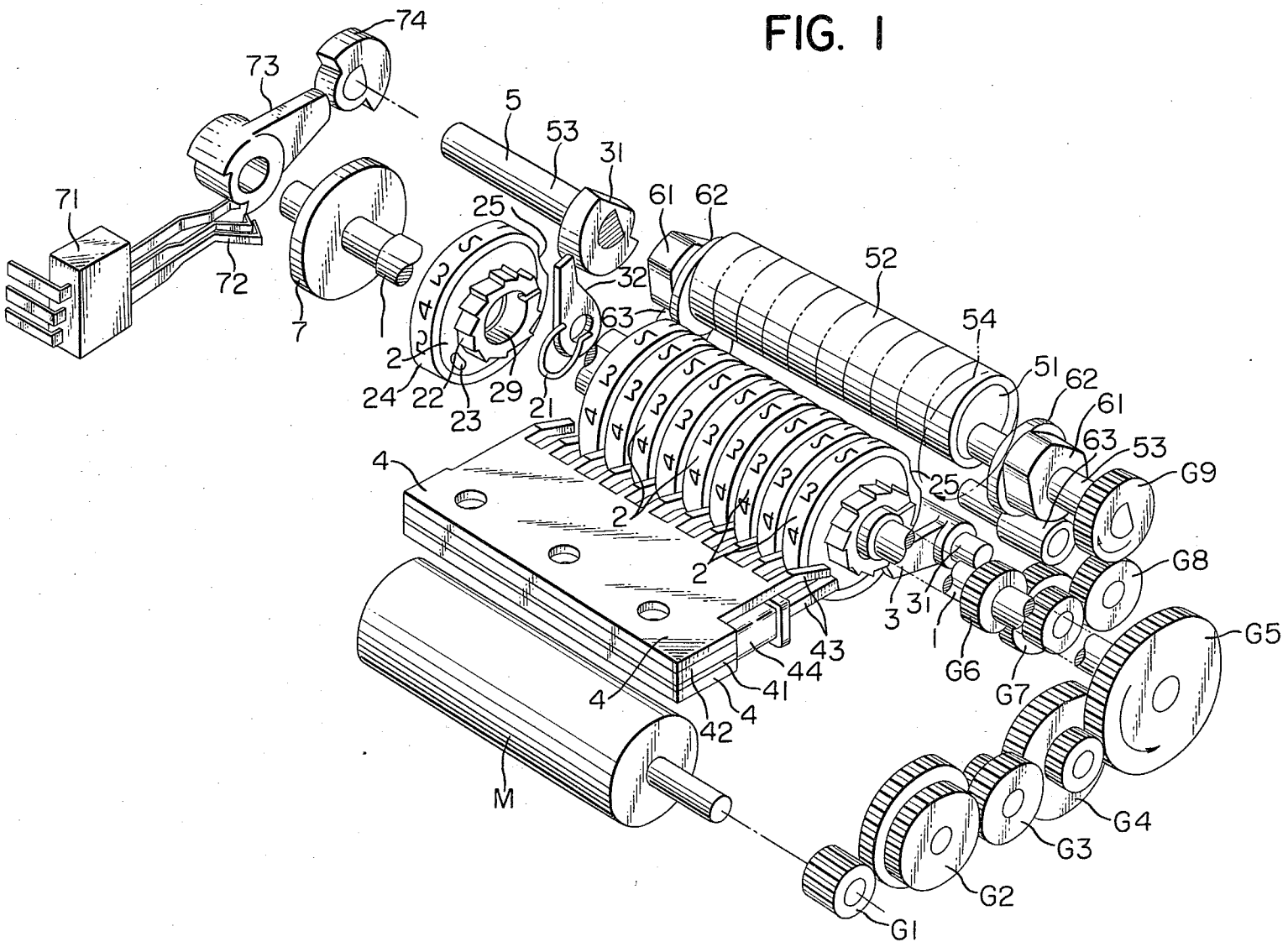
FIG. 1 is an exploded perspective view of essential portions of a character wheel selection type printing apparatus.

The illustrated embodiments will hereinafter be described. First, the character wheel selection type printing apparatus shown in the drawings will be described.

In FIG. 1, reference numeral 1 designates a character shaft rotatably journalled to and between the opposed side walls of the chassis C (or the outer case, see FIG. 11) of the apparatus. Designated by 2 is a plurality of column character wheels (character members) rotatably supported on the character shaft 1. Each character wheel 2 is frictionally engaged with the character shaft 1 by a friction spring 21 in the form of a cut-away ring having a small diameter or the form of a torsion coil spring. A ratchet 22 is provided on the side of each character wheel 2 and serves to engage a set lever 3 during the printing to make the character wheel 2 stationary so that a desired character becomes stationary at the print position. An oval-shaped yoke 23 formed of a ferromagnetic material is provided on the side of each character wheel 2 and forms a magnetic circuit with the character selecting comb-tooth magnetic poles 43, 43 of upper and lower comb-tooth-like magnetic plates 4, 4 sandwiching therebetween a permanent magnet 41 and a spacer yoke 42 so that during the waiting, the character wheels 2 are kept stationary by magnetic engagement and that during the character selection, a character selecting coil 44 inserted over one of the magnetic poles 43, 43 is electrically energized at a timing synchronous with the rotation of the character shaft 1 to thereby cut off the magnetic engagement and cause the character wheels 2 to frictionally engage the character shaft 1 with the aid of the coiling force of the spring 21.

On the outer periphery of each character wheel 2, there are provided alphanumeric characters 24 formed of a porous, elastic plastic material and these characters 24 are impregnated with ink.

M represents a motor and in the apparatus of the present embodiment, it is a coreless motor. The motor M drives the character shaft 1 through gears G1-G5 and also drives a platen shaft 5 through gears G6-G9.

Designated by 52 is a printing ring (platen) rotatably supported on the eccentric shaft portion 51 of the platen shaft 5. The printing ring 52 urges printing paper P (FIG. 8A) against the characters and effects printing with the aid of the eccentric rotational action of the eccentric shaft portion 51 in synchronism with a desired character on the outer periphery of the character wheels being made stationary at the print position by the set lever 3.

Figure 3:
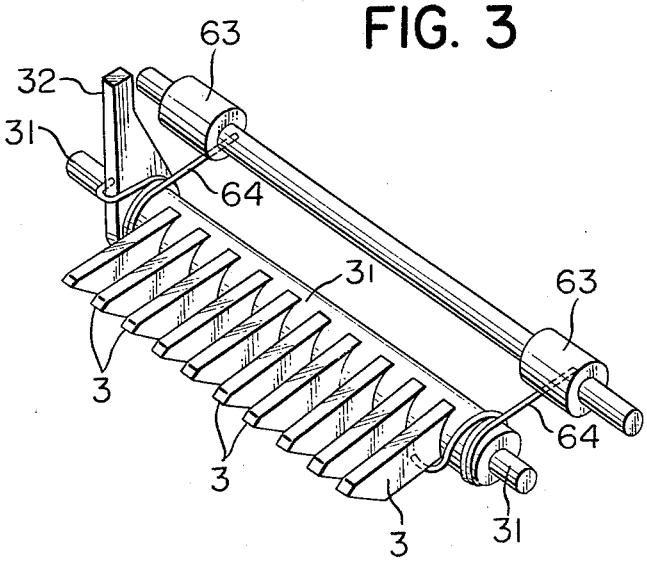
FIG. 3 is a perspective view of set levers and pinch rollers.
Figure 4:
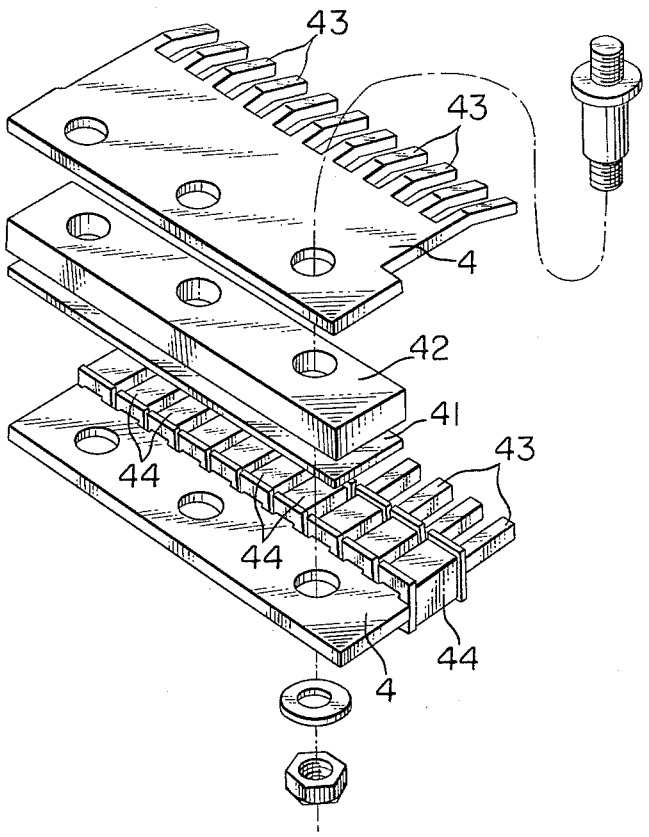
FIG. 4 is an exploded perspective view of a comb-tooth electromagnetic mechanism.
Figure 5A:
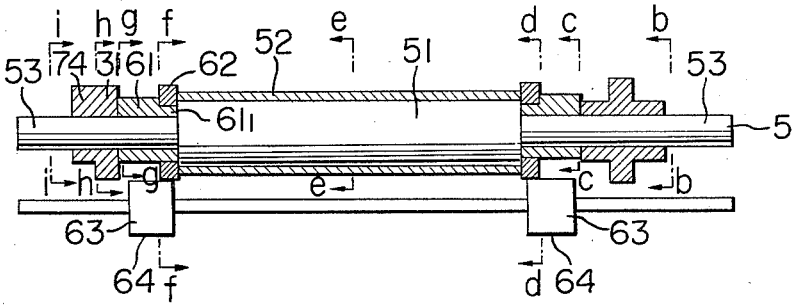
FIG. 5*a* is a vertical cross-sectional front view of a platen shaft.
Figure 5B:
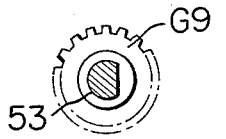
FIGS. 5*b*–5*i* are cross-sectional views taken along lines b—b, c—c, d—d, e—e, f—f, g—g, h—h and i—i, respectively, in FIG. 5*a*.
Figure 5C:
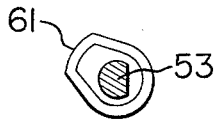
Figure 5D:
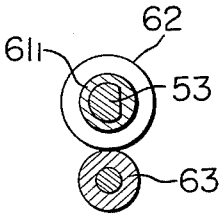
Figure 5E:
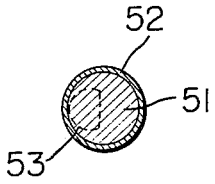
Figure 5F:
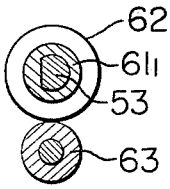
Figure 5G:
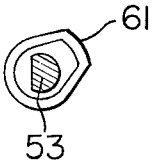
Figure 5H:
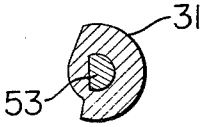
Figure 5I:
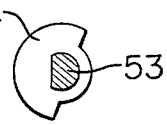

On the platen shaft 5, there is provided a control cam 31 for the set lever 3 and are also provided paper feed cams 61, 61 and stop rings 62, 62 at the opposite ends of the printing ring 52. The set lever cam 31 rotates the set lever 3 about a shaft $3_1$ (FIGS. 1 and 3) at a predetermined timing to make the character wheels 2 stationary. The paper feed cams 61, 61 engage pinch rollers 63, 63 to effect paper feed at a predetermined timing. The stop rings 62, 62 also engage the pinch rollers 63, 63 to stop the printing paper P when no paper feed is taking place.

On the character shaft 1, a detecting print plate 7 having a radial pattern is provided for rotation with the character shaft 1 and detects the character shaft angular position by means of the plate spring contact 72 of a character shaft angular position detector 71. A contact control lever 73 is provided coaxially with the detecting print plate 7 so as to control the detector output signal by means of a detection cam 74 provided on the platen shaft 5.

Operations of various portions of the printer will now be described.

First, the various portions of the printer are registered to the waiting position. In what conditions the various portions of the printer are stationary is not clear after the printer has been left unused and therefore, the various portions are registered to the waiting position by effecting idle operation of the printer over one or more printing cycle.

Figure 6A:
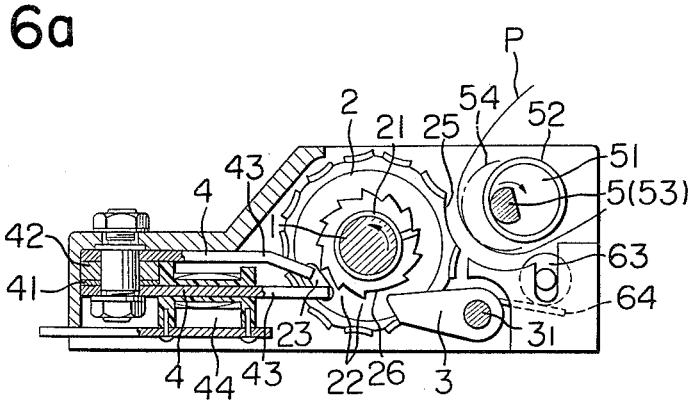
FIGS. 6A to 6D show the conditions of various portions of the apparatus during the waiting.
Figure 6B:
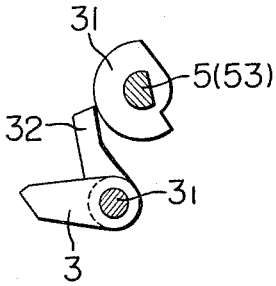

FIG. 6A shows such waiting position. In the unused condition of the printer, if the character wheel 2 is not stationary at the waiting position shown in FIG. 6A, the character wheels 2 are frictionally engaged with the character shaft 1 by the friction springs 21, so that they are rotated by the rotation of the character shaft 1 which results from the aforementioned idle operation. When the character wheels 2 are rotated to the waiting operation shown in FIG. 6A, the oval-shaped yoke 23 provided on side of each character wheel, the character selecting magnetic poles 43, 43, the permanent magnet 41 and the spacer yoke 42 together form a closed magnetic circuit, so that the oval-shaped yoke 23 is attracted to the magnetic poles 43, 43 and there is produced a friction force which makes the character wheels 2 stationary. The elements of the aforementioned magnetic circuit are preset so that the force making the character wheels 2 stationary which results from the attracting friction force between the magnetic poles 43, 43 and the oval-shaped yokes 23 is greater than the rotational force of the character wheels which results from the frictional engagement between the character wheels 2 and the panel 21 of the character shaft 1, and the character wheels 2 become stationary at the waiting position shown in FIG. 6A. The character shaft 1 continues to rotate and when the character wheels 2 of all columns become stationary at the waiting position and each member comes to the waiting position as shown in FIGS. 6B, C and D, the idle operation is stopped and a print instruction signal is waited for. In the waiting position of FIG. 6A, the printing ring 52 is being rotated while being most spaced apart from the character wheels 2, and the set lever 3 escapes to a position in which it does not engage the ratchet 22 of the character wheel 2, due to the engagement between an arm 32 integral with the lever shaft $3_1$ and the cam 31 (FIG. 6B). Also, an escape corresponding to the rotational locus 54 (FIGS. 6A and 1) of the printing ring 52 is provided at the location of the character wheel 2 which is opposed to the printing ring 52 and in the present embodiment, such escape is an arcuate escape 25. Further, the ratchet of the character wheel 2 is not provided only at a location 26 which is opposed to the set lever 3. Also, to enhance the accuracy of the position whereat the character wheel 2 becomes stationary during the waiting, the spacing between the two comb-tooth-like magnetic poles 43 and 43 in the portion thereof which engages the oval-shaped yoke 23 of the character wheel is made small.

When the various portions of the printer assume the waiting position of FIGS. 6A–D and the printer control device receives printing data and completes its preparation for control, the motor M (FIG. 1) is electrically energized to start the printing operation.

Figure 10:
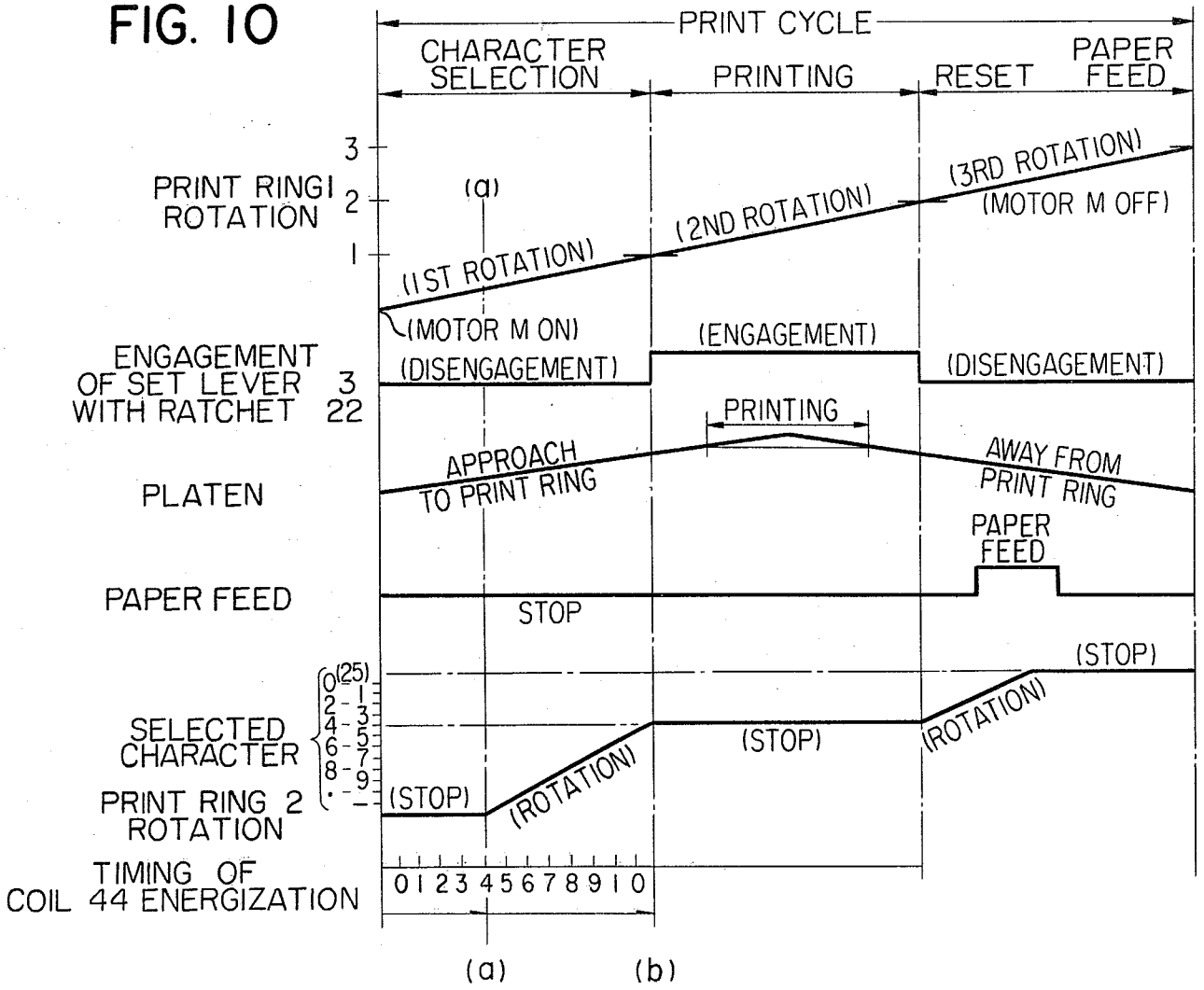
FIG. 10 is a timing chart.

In the apparatus of the present embodiment, as shown in the timing chart of FIG. 10, three full rotations of the character shaft 1 in one direction which is driven by the motor M through the gears G1–G5 forms one printing cycle, that is, character selection takes place during the first full rotation of the character shaft 1, printing takes place during the second full rotation, and resetting of the character wheels and paper feed takes place during the third full rotation.

When the motor M is electrically energized in the waiting position of FIG. 6A, the character shaft 1 starts to be rotated in the direction of arrow. In this condition, the character wheel 2 is still stationary overcoming the frictional rotation force of the character shaft 1 due to the attracting friction force between the character selecting magnetic poles 43, 43 and the oval-shaped yokes 23.

Figure 7A:
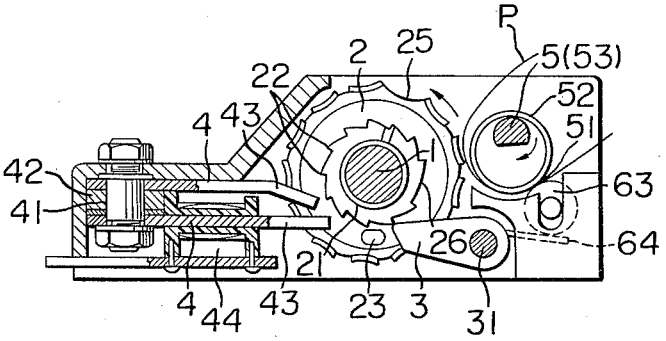
FIGS. 7A–7D show the conditions of various portions of the apparatus during the character selecting process.

The character shaft 1 continues to rotate and when it rotates to the position (A), for example, in the timing chart of FIG. 10, the character selecting coil 44 is electrically energized in a direction to negate the magnetic flux and release of the magnetic engagement is effected thereby, so that the particular character wheel 2 starts to rotate with the character shaft 1 due to the frictional coupling thereof with the shaft 1. If the power supply to the coil 44 is continued until the oval-shaped yoke 23 rotates to a position in which it is not in contact with the magnetic poles 43, 43 as shown in FIG. 7A, the character wheel will continue to rotate due to the magnetic engagement without becoming stationary even if the power supply is stopped thereafter. As described above, selective rotation of the character wheels 2 is made possible by a small power supplied for a very short time. The rotated position A of the shaft in the timing chart of FIG. 10 used in the foregoing description is the timing at which the character "4" comes to the print position during the printing, and if power is supplied to the coil 44 at other timing during the character selection stroke, other character will come to the print position. If no power is supplied to the coil 44, the rotation of the character wheel 2 will not take place and the escape 25 will take the place of the print position and thus, printing of unnecessary columns will not take place.

Figure 8A:
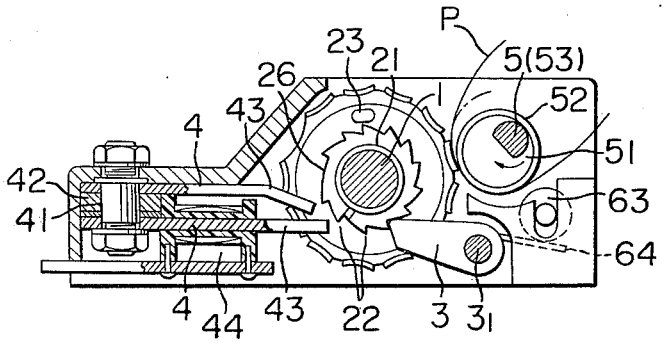
FIGS. 8A–8D show the conditions of various portions of the apparatus at the end of the character selection.

When the selective rotation of the character wheels of all columns has been completed with the character shaft 1 coming to a position in which it has effected one full rotation from the start of rotation, namely, the position B in the timing chart of FIG. 10, the set lever 3 is actuated by the action of the set lever cam 31 provided on the platen shaft 5 and assumes a position in which it engages the ratchet of the character wheel 2 as shown in FIG. 8A, and it engages the ratchet 22 of the character wheel 2 being rotated due to the friction engagement thereof with the character shaft 1 to mechanically stop the rotation of that character wheel 2 and at this time, a character being stationary at the position opposed to the printing ring 52 is printed. As described above, synchronization is mechanically taken between the operation of the character shaft 1 and that of the set lever 3 and therefore, by controlling the timing at which the character wheel 2 starts to rotate during character selection and bringing the character wheel 2 and the character shaft 1 into friction engagement with the positional relationship therebetween in the direction of rotation being selected, a character being stationary at the position opposed to the printing ring 52 may be selected by the set lever 3 during the printing.

When the character wheel 2 of each column is made stationary by the set lever 3, the printing ring 52 supported on the eccentric shaft portion 51 of the platen shaft 5 being continuously rotated in synchronism with the character shaft 1 urges the printing paper P against the selected stationary character by the eccentric rotational action thereof, whereby printing is effected (FIG. 8A). Since the character wheel 2 and the character shaft 1 are in frictional engagement with each other, the character shaft 1 need not be stopped but may be continuously rotated even after the character wheel has been made stationary by the set lever 3 and thus, the drive mechanism for the character shaft 1 can be very much simplified.

Figure 9A:
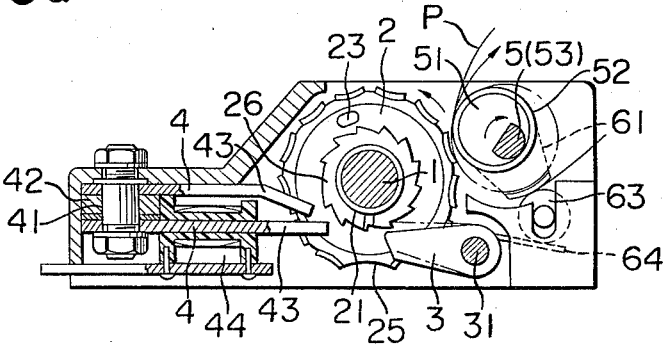
FIGS. 9A–9D show the conditions of various portions of the apparatus during the reset process.

When the printing is completed and the printing ring 52 becomes sufficiently spaced apart from the character wheels 2, the set lever 3 is operated to move away from the ratchet 22 of the character wheel 2 as indicated by solid line in FIG. 9A, and the character wheel 2 again comes into friction coupling with the character shaft 1 and is rotated to enter the reset stroke. Simultaneously therewith, the paper feed cams 61, 61 provided on the platen shaft 5 engage the pinch rollers 63, 63 (FIG. 9C) to feed the printing paper P by an amount corresponding to one line. Then, when the character wheel 2 with the shaft 1 is rotated to the waiting position of FIG. 6A, the oval-shaped yoke 23 of the character wheel 2 and the magnetic poles 43, 43 again form a closed magnetic circuit and the character wheel 2 is made stationary at the waiting position of FIG. 6A. The character shaft 1 further rotates to the waiting position and by the cessation of the operation of the motor M, the other mechanism portions are also stopped at the waiting position as shown in FIGS. 6B, C and D, thus completing one printing cycle.

In the apparatus of the present embodiment, as described above, the character shaft 1 makes three full rotations while the platen shaft 5 makes one full rotation, during one printing cycle. Thus, the two shafts 1 and 5 can be directly driven by the motor M only through a gear train and the synchronization between the two shafts can also be ensured.

Figure 6C:
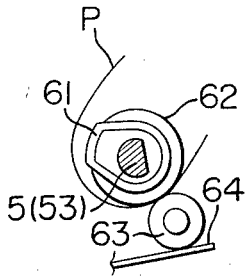
Figure 6D:
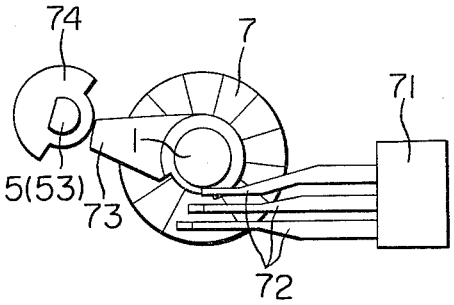
Figure 7B:
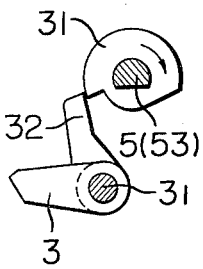
Figure 7C:
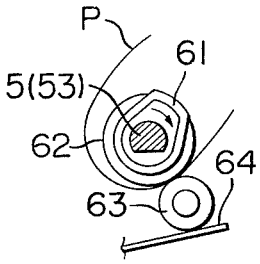
Figure 7D:
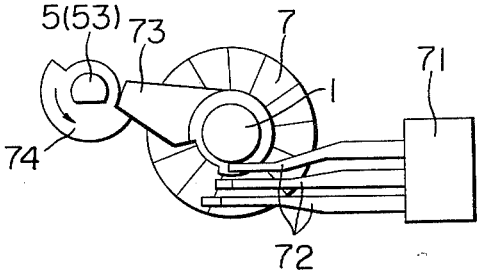
Figure 8B:
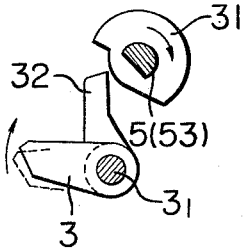
Figure 8C:
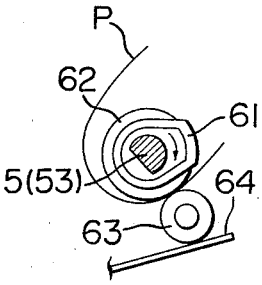
Figure 8D:
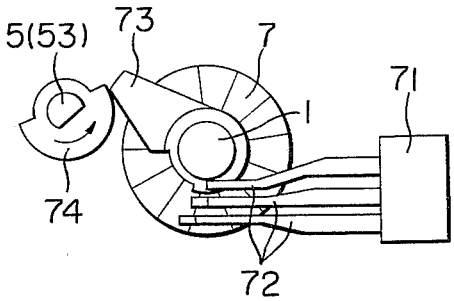
Figure 9B:
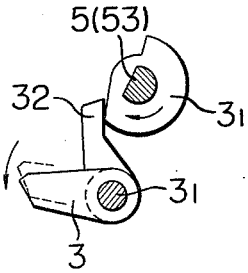
Figure 9C:
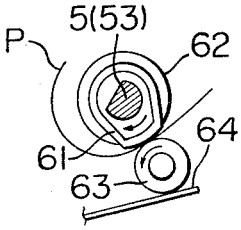
Figure 9D:
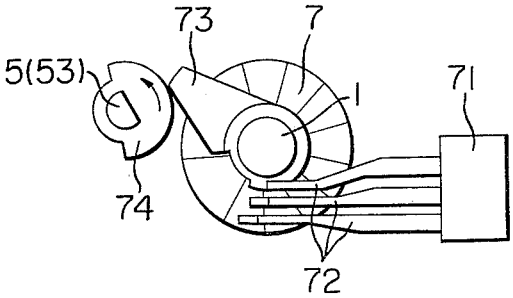

FIGS. 6B–D respectively show the relation between the set lever 3 and the control cam 31, the relation between the paper feed cam 61, the stop ring 62 and the pinch roller 63, and the relation between the detector contact control lever 73 and the detection cam 74, all during the waiting condition; FIGS. 7B–C show the same relations during the character selecting stroke; FIGS. 8B–C show the same relations during the printing stroke; and FIGS. 9B–C show the same relations during the paper feed stroke.

The character wheels (character members) 2 will be described in a little more detail by reference to FIG. 2. Each character wheel 2 comprises a character retaining wheel member $2_1$ and a character wheel member $2_2$ having a required number of characters 24 (0–9, ·, —) formed on the outer periphery thereof.

Figure 2A:
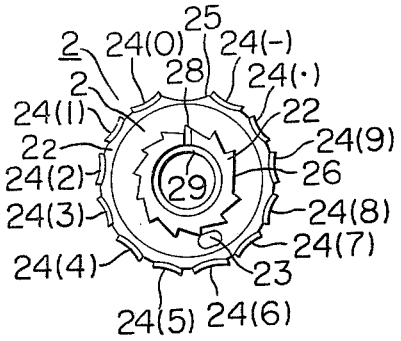
FIG. 2*a* is a side view of a character wheel.
Figure 2B:
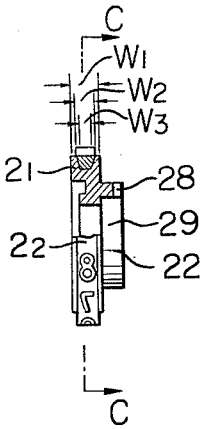
FIG. 2*b* is a partly cut-away front view of the character wheel.
Figure 2D:
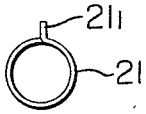
FIG. 2*d* is a side view of a friction spring.
Figure 2C:
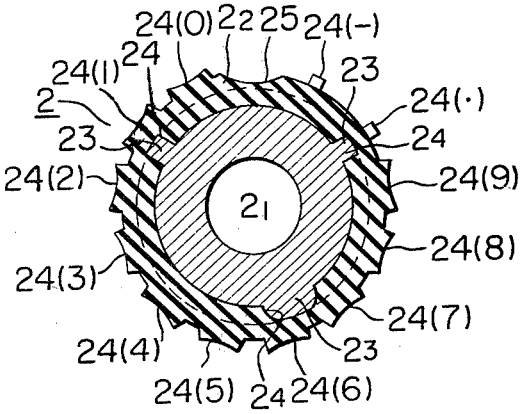
FIG. 2*c* is an enlarged, vertical cross-sectional view of the character wheel taken along line c—c in FIG. 2*b*.
Figure 2E:
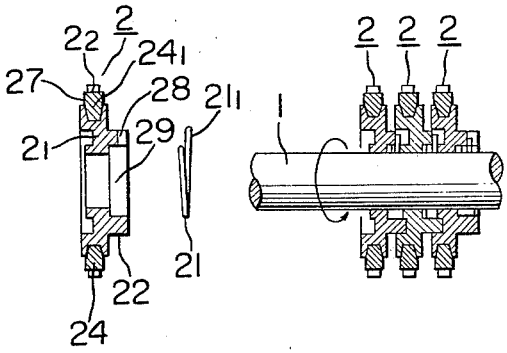
FIG. 2*e* illustrates the manner in which character wheels of respective columns are assembled to a character shaft.

The character retaining wheel member $2_1$ has a trapezoid groove 27 (FIG. 2*e*) formed over the entire periphery thereof and an engaging portion $24_1$ of trapezoid cross-section formed on the inner periphery of the character wheel member $2_2$ is fitted in the groove 27, whereby the character wheel member $2_2$ is fitted over the character retaining wheel member $2_1$. As shown in FIG. 2*c*, a circumferential positioning projection $2_3$ is formed in the groove 27 of the character retaining wheel member $2_1$ and a positioning cut-away portion $2_4$ is provided in the character wheel member $2_2$. By engagement between the projection $2_3$ and the cut-away $2_4$, the circumferential positioning of the character retaining wheel member $2_1$ and the character wheel member $2_2$ is accomplished. Further, the engaging portions 27 and $24_1$ of the character retaining wheel member $2_1$ and character wheel member $2_2$ are of trapezoid cross-section, that is, the width $W_3$ of the inner periphery (FIG. 2*b*) is smaller than the width $W_2$ of the outer periphery, whereby the widthwise positioning of the character wheel member $2_2$ with respect to the character retaining wheel member $2_1$ is automatically accomplished simply by fitting the inner periphery of the character wheel member $2_2$ on the outer peripheral groove 27 of the character retaining wheel member $2_1$.

Accordingly, even if the engaging portions 27 and $24_1$ have some dimensional error, the character wheel member $2_2$ may be sufficiently stably fixed to the outer periphery of the character retaining wheel member $2_1$. Also, the pressure force applied to the characters 24 during the printing is applied to the character retaining wheel member $2_1$ along the trapezoid surface of the engaging portions 27 and $24_1$, so that even during the printing, the characters 24 are reliably held at predetermined positions and the parallelism between the character surface and the character shaft 1 is also kept and moreover, since no force is applied axially of the characters, the impregnating ink never oozes out of the character side surface. Since there is no ooze of the ink, the portion of engagement between the character wheel member $2_2$ and the character retaining wheel member $2_1$ can also be impregnated with ink.

Further, due to the trapezoid shape of the engaging portions, engaging force and printing pressure force applied are not concentrated at a point and this permits the use of characters having great elasticity as well as the use of an increased amount of impregnating ink and can enhance the quality of the print.

The oval-shaped yoke 23 is provided on the side of the character retaining wheel member $2_1$ by one of the methods such as force-in, adhesion, insert shaping, etc. The oval-shaped yoke 23 is formed of a ferromagnetic material and is in the form of a plate as shown.

The character retaining wheel member $2_1$ also has a ratchet portion 22, a spring hooking groove 28 and a spring inserting portion 29 on the side thereof.

The ratchet portion 22 engages the set lever 3 during the printing to stop the character wheel 2 so that a desired character comes to the print position. Consequently, the ratchet pawl of the ratchet portion 22 and the characters on the character wheel are so arranged that they have a predetermined circumferential positional relationship. Also, as already described, no ratchet pawl is provided at the position 26 which becomes opposed to the set lever 3 during the waiting (FIG. 6A). The reason is this. When no printing is taking place, no power is supplied to the selecting coil 44 and therefore, the character wheel 2 is not rotated cut the set lever 3 is actuated as it remains in the waiting position, thus entering the printing stroke. If, at this time, there is some error in the resting position of the character wheel 2 during the waiting, the set lever 3 may strike against the upper portion of the ratchet to thereby preclude normal operation from being performed. Consequently, the resting of the character wheel 2 at its resting position during the waiting is accomplished by enhancing the accuracy of the position whereat it is attracted to rest by the oval-shaped yoke 23 and no ratchet is provided at the position which becomes opposed to the set lever 3 during said resting, thereby achieving improved reliability and reduced cost.

The character wheels 2 are inserted over the character shaft 1 over a required number of columns. In this case, one friction spring 21 for each character wheel is inserted over the character shaft 1 and is positioned at the spring inserting portion 29 of the character wheel 2 and the hook $\mathbf{21}_1$ of the friction spring 21 is inserted and engaged in the spring hooking groove 28 of the character wheel 2.

The inside diameter of the friction spring 21 is appropriately smaller than the outside diameter of the character shaft 1 and the character wheel 2 is frictionally engaged with the character shaft 1 through the friction spring 21, the hook $\mathbf{21}_1$ and the spring hooking groove 28 to thereby enable the resting and rotation of the character wheel during character selection and printing.

Comb-tooth-like character selecting magnetic poles 43, 43 and a set lever 3 are positioned between adjacent ones of the character wheels 2 arranged on the character shaft 1 to control the rotation and resting of each character wheel 2 and the arrangement of each character wheel 2 is accomplished by the comb-tooth-like character selecting magnetic poles 43, 43. Also, each character wheel 2 is combined with an adjacent character wheel in a convex-concave telescopic fashion so that the spring hooking groove 28 does not appear the portion of engagement between the ratchet 22 and the set lever 3, thereby preventing the set lever 3 from engaging the spring hooking groove 28 or the hook $\mathbf{2}_1$ of the friction spring which is exposed outside of the ratchet from the spring hooking groove 28 to cause malfunctioning.

The character wheel member $\mathbf{2}_2$ including characters 24 is formed of a porous, elastic plastic material such as foamed polyethylene, foamed polyurethane or foamed NBR and is impregnated with printing ink. The character selecting magnetic poles 43, 43 and set lever 3 are positioned on the side of the portion of engagement between the character wheel member $\mathbf{2}_2$ and the character wheel 2 and when contacting the character wheel member $\mathbf{2}_2$ impregnated with ink, the character selecting magnetic poles 43, 43 and set lever 3 may be stained and the ink may flow along these members to stain other members. Therefore, as shown in FIG. 2*b*, the width $W_1$ of the outer peripheral portion of the character retaining wheel member $\mathbf{2}_1$ is made greater than the width $W_2$ of the character wheel member $\mathbf{2}_2$ so that the character selecting magnetic poles 43, 43 and set lever 3 may not contact the character wheel member $\mathbf{2}_2$.

Printing is effected with the printing paper P urged against the surface of the characters 24 by the eccentrically rotated platen or printing ring 52 and for this purpose, the surface of the characters is arcuate with the upper and lower portions thereof being great in height and with the central portion thereof being low in height. Further, the base portion of each character is in an arcuate shape concentric with the surface of each character and the height from the base portion to the surface of each character is constant in any portion of the character, thereby preventing disorder of the print which would otherwise be caused by nonuniform deformation of the character resulting from the pressure during the printing. Also, due to the aforementioned shape, the volume of the character base portion is increased to thereby enable the amount of ink impregnation to be increased.

The character wheel 2 has an outer periphery permitting N+1 to N+3 characters to be arranged thereon, where N is the number of necessary characters to be arranged on the outer periphery. In the shown embodiment, the character wheel 2 has an outer periphery permitting arrangement of N=12 necessary characters plus one character, thus total thirteen characters, and the additional one character provides a platen escape blank 25.

In the present embodiment, the character retaining wheel member $\mathbf{2}_1$ itself is formed of a material which cannot be impregnated with ink, for example, polyacetal resin and further, the width $W_1$ of the character retaining portion thereof is greater than the width $W_2$ of the character wheel member $\mathbf{2}_2$ as mentioned above, whereby the ink-impregnated character wheel member $\mathbf{2}_2$ does not contact other members and this eliminates malfunctioning of the printing apparatus which would otherwise be caused by the other members being stained with ink and thus, there can be provided a printing apparatus of high reliability. Also, the character retaining member serves as a stain preventing member and further as an arrangement guide member for the character members and therefore, the number of parts is greatly reduced to enable the provision of a compact printing apparatus which is high in reliability and low in cost. In the present embodiment, the printing mechanism uses character members in the form of character wheel, but it could be readily understood that the use of character bars would also result in the greatest effect.

Also, in the present embodiment, with the load to the character wheels 2 during the driving thereof being taken into account, no ink roller and no ink ribbon is used but instead, the characters 24 are impregnated with printing ink and further, to reduce the inertia of the character members, the character retaining wheel member $\mathbf{2}_1$ is formed of light-weight plastics and the driving of the character wheel 2 by the shaft 1 is made possible by a small engaging force such as friction engagement or the like, but where an ink ribbon, for example, is used, an ink ribbon guide member may be provided so as to prevent the ink ribbon from touching the characters of the character wheels, thereby reducing the force required to drive the character wheels.

Also, an eccentric platen is used as the impression mechanism, but other plate-like platen may alternatively employed without any problem.

The platen portion will now be described in a little more detail by reference to FIG. 5.

The platen shaft 5 is driven from a motor M (FIG. 1) through the gear G6 secured to the character shaft 1 and through the gear train G7–G9 and is designed so that it makes one full rotation during one printing cycle with respect to the character gear G6 which makes three full rotations during one printing cycle. By a ring-like impression member (printing ring) 52 rotatably supported on an eccentric shaft portion 51, the printing paper P is urged against a character which has been selectively made stationary at the print position, due to the eccentric effect of the platen shaft 5 at predetermined printing timing, thus accomplishing the printing.

Since the platen shaft 5 makes one full rotation during one printing cycle as described above, synchronous driving of each mechanism portion operated at predetermined timing with respect to the printing cycle is accomplished by the shaft 5.

Figures 11, 12, 13:
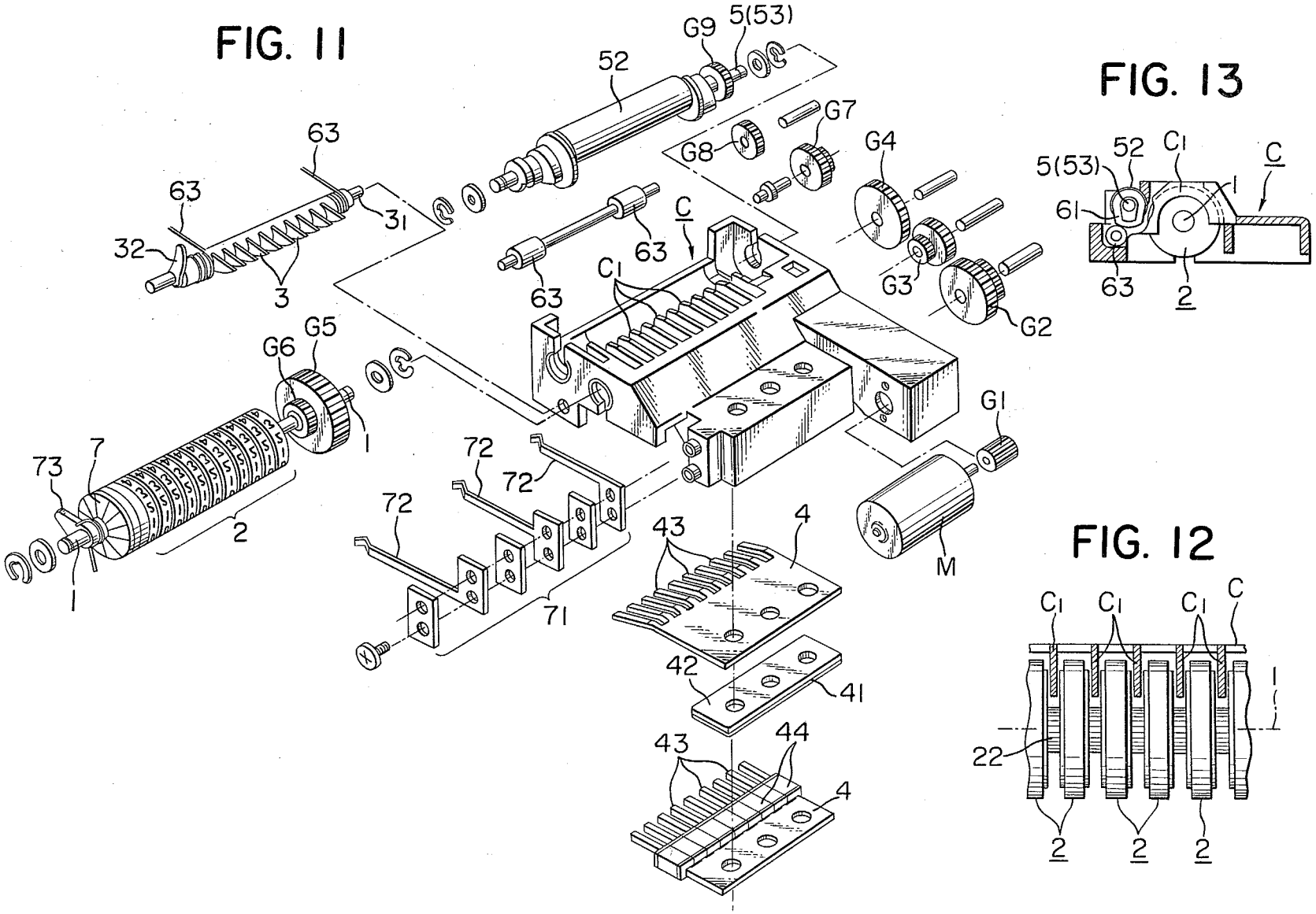
FIG. 11 is an exploded perspective view of the apparatus including a chassis.
FIG. 12 is a cross-sectional view showing spacer members entering between character wheels.
FIG. 13 is a side view corresponding to FIG. 12.

That is, the platen shaft 5 has its opposite ends comprising cam shaft portions 53, 53 and its central portion comprising an eccentric shaft portion 51 eccentric with respect to the cam shaft portions, and the outermost ends of the cam shaft portions are rotatably journalled to an apparatus chassis C (FIG. 11).

The cam shaft portions 53, 53 are formed so as to have a D-shaped cross-section, and between the bearing and the eccentric shaft portion 51, the platen shaft driving gear G9, paper feed cams 61, 61, set lever cam 31 and detector cam 74 are coupled to the cam shaft portions 53, 53 with synchronization taken due to the D-shaped cross-section. Also, shaft portions $61_1$ and $61_1$ are provided on the side of the paper feed cams 61 and 61 which is adjacent to the eccentric shaft portion 51, and paper keep rings 62 and 62 are rotatably supported on these shaft portions $61_1$ and $61_1$.

When the preparation for printing is completed and the motor M starts to rotate, the platen shaft 5 also starts to be rotated by the platen shaft driving gear G9 in synchronism with the rotation of the motor.

When desired characters of all columns are selected, the set lever 3 is actuated by the action of the set lever cam 31 to cause the character wheel 2 to rest so that the desired characters come to the print position (FIG. 8A).

When the character wheel 2 is so caused to rest, the impression member 52 supported on the eccentric portion 51 urges the printing paper P against the characters due to the eccentric action of the continuously rotating platen shaft 5 to thereby effect the printing (FIG. 8A), and then the printing paper P is disengaged from the characters by continued rotation of the platen shaft (FIG. 9A).

When the selection of the character wheel 2 is terminated and the printing operation is entered, the character shaft 1 has already made one full rotation, and even when the printing cycle is then entered, the character shaft 1 continues to be rotated and the relation between the spring contact 72 of the detector 71 and the pattern of the detection plate 7 enters a second cycle. Thereupon, the detection lever 73 is actuated by the detector cam 74 to prevent the timing signal from the detector 71 from being put out.

When the printing cycle is completed, the set lever 3 is actuated by the set lever cam 31 so as to release the character wheel 2 (FIGS. 9A and B), thus resetting the character wheel 2, and paper feed takes place simultaneously with the resetting of the character wheel 2.

The paper feed cams 61, 61 are engaged with the platen shaft 5 so that the cam portions thereof come round to the position opposed to pinch rollers 63, 63 (FIG. 9C) substantially simultaneously with the completion of the printing cycle, and depress the pinch rollers 63, 63 with the printing paper P interposed therebetween and urge the printing paper P against the cam portions by the reaction force of springs 64, 64 engaged with the pinch rollers, thereby feeding the printing paper by an amount equal to the length of the arc of the cam portions.

When the paper feed is completed and the cam portions of the paper feed cams 61, 61 are disengaged from the pinch rollers 63, 63, the pinch rollers 63, 63 are moved upwardly by the force of the springs 64, 64 to urge the printing paper P against the paper keep rings 62, 62.

The springs 64, 64 are hooked to the rotating portions of the pinch rollers 63, 63 and by setting the diameter of the spring-hooked portions to a suitable value, the pinch rollers 63, 63 are designed so as to rotate with a suitable degree of rotational resistance. By such rotational resistance of the pinch rollers 63, 63, the printing paper P nipped between the pinch rollers 63, 63 and the paper keep rings 62, 62 is maintained stationary until the next paper feed is effected. The paper keep rings 62, 62 are also rotatably supported on the shaft portions $61_1$, $61_1$ of the cams 61, 61 and are therefore maintained stationary independently of the rotation of the platen shaft 5. Further, where it is desired to manually feed the printing paper P by a necessary amount without operating the printer, paper feed can be freely accomplished by manually pulling the printing paper P with a suitable degree of force because the rotational resistance of the pinch rollers 63, 63 is set to a suitable value.

Various cams are concentrically and collectively provided on a single platen shaft 5, as described above, and this leads to simplicity of the structure and the possibility of controlling the operations of the various portions of the printer in accurate synchronism with each other, as well as high reliability, durability and compactness of the printer.

The platen shaft 5 has the cam shaft portions 53, 53 and eccentric shaft portion 51 and is so designed that the configuration of the cam shaft portions 53, 53 is always at a position inward of or equal to the outside diameter of the eccentric shaft portion 51. Thus, even if the platen shaft 5 is formed as a unitary structure, it is possible to assemble thereto the impression member 52, etc. which engage the platen shaft 5. In the present embodiment, the platen shaft 5 is formed by unitary shaping of plastics, whereby achieving high accuracy and reduced cost.

The printing ring 52 may be formed by dividing it into individual columns as indicated by dots-and-dash lines in FIG. 1. The printing ring 52 is higher in hardness than the character wheels. Also, the eccentric platen shaft 51 is higher in hardness than the printing ring 52. It is also important to maintain constant the spacing (pitch) P between the character wheels of the respective columns to thereby prevent irregularity of the spacing between printed characters of the respective columns and character selection malfunctioning which would result from deviation of the character wheel 2 of each column in the thrust direction and for this purpose, as shown in FIGS. 11 to 13, spacer members $C_1$ entering between adjacent character wheels 2 to control the spacing P therebetween are integrally formed with the chassis C or outer case of the apparatus.

That is, due to the presence of the spacer members $C_1$, the character wheels 2 of the respective columns are partitioned and located on the shaft 1 and also the pitch P of the character wheels is maintained constant. Accordingly, the characters of the respective columns are not deviated in the thrust direction, and irregularity of the spacing between printed characters of the respective columns or character selection malfunctioning which would otherwise result from deviation of the characters may be eliminated.

Also, since the spacer members $C_1$ are integral with the chassis C or outer case of the printing apparatus, the spacer members can be shaped integrally therewith when the chassis C or the outer case is formed by a plastic injection molding method, thereby reducing the number of parts, the number of assembly steps and the cost.

What we claim is:

1. A printing apparatus of the character wheel selection, stop and simultaneously printing type comprising:

a plurality of character wheels;

a shaft rotatably bearing said character wheels;

a plurality of friction springs engaged with said character wheels each having a normally smaller inner diameter than the diameter of said shaft to frictionally engage the circular surface thereof and thereby transmit a rotational force from said shaft to said character wheels;

a ferro-magnetic member provided on a side of each of said character wheels;

a comb-tooth-like magnetic plate having a permanent magnet and being magnetically engagable with said ferro-magnetic members to thereby apply a restraining force to said character wheels;

a plurality of coils each associated with a character wheel for disengaging said magnetic plate from said ferro-magnetic members at selected times, thereby causing associated character wheels to rotate with said shaft under the rotational forces transmitted by said springs;

stop means for simultaneously causing each of said character wheels to be stationary at a prescribed printing position;

an eccentrically mounted printing platen for effecting printing when said plural character wheels are caused to be stationary by said stop means;

gears for rotating said shaft and said printing platen; and a motor engaged with said gears;

wherein, during a first rotation of said shaft, said coils are selectively energized to cause associated character wheels to rotate therewith, during a second rotation of said shaft, said stop means causes said character wheels to be stationary at prescribed printing positions and said platen effects printing, and during a third rotation of said shaft, said stop means releases said character wheels causing them to rotate to prescribed reset positions to be there restrained by said magnetic plate.

2. A printing apparatus according to claim 1, wherein each of said character wheels is impregnated with printing ink.

3. A printing apparatus according to claim 1, wherein said comb-tooth-like magnetic plate comprises a pair of members between which said permanent magnet is interposed.

4. A printing apparatus according to claim 1, wherein said printing platen is divided into individual columns.

5. A printing apparatus according to claim 1, wherein said motor comprises a d.c. motor.

* * * * *